US010222164B2

(12) United States Patent
Caravaggi et al.

(10) Patent No.: US 10,222,164 B2
(45) Date of Patent: Mar. 5, 2019

(54) EXTENSION DEVICE OF A FIREARM

(71) Applicant: FABBRICA D'ARMI PIETRO BERETTA S.p.A., Gardone val Trompia, Brescia (IT)

(72) Inventors: Fausto Caravaggi, Brescia (IT); Ivano Contin, Brescia (IT)

(73) Assignee: FABBRICA D'ARMI PIETRO BERETTA S.p.A., Gardone val Trompia, Brescia (IT)

( * ) Notice: Subject to any disclaimer, the term of this patent is extended or adjusted under 35 U.S.C. 154(b) by 0 days.

(21) Appl. No.: 15/800,797

(22) Filed: Nov. 1, 2017

(65) Prior Publication Data

US 2018/0142980 A1 May 24, 2018

(30) Foreign Application Priority Data

Nov. 22, 2016 (IT) ..... 102016000117919

(51) Int. Cl.

| | |
|---|---|
| ***F41A 21/32*** | (2006.01) |
| ***F41A 21/40*** | (2006.01) |
| ***F41G 1/02*** | (2006.01) |
| ***F41A 21/48*** | (2006.01) |

(52) U.S. Cl.

CPC ..... *F41A 21/32* (2013.01); *F41A 21/40* (2013.01); *F41G 1/02* (2013.01); *F41A 21/482* (2013.01)

(58) Field of Classification Search

CPC ..... F41A 21/32; F41A 21/325; F41A 21/40; F41A 21/482; F41G 1/02

USPC ..... 42/76.01, 79; 89/14.05

See application file for complete search history.

(56) References Cited

U.S. PATENT DOCUMENTS

| | | | | |
|---|---|---|---|---|
| 2,489,568 | A * | 11/1949 | Ferhat | F41A 21/40 42/79 |
| 2,932,915 | A * | 4/1960 | Wilson | F41A 21/40 42/79 |
| 4,467,546 | A * | 8/1984 | Beretta | F41A 21/40 42/79 |
| 5,157,211 | A * | 10/1992 | Mossberg | F41A 21/40 42/79 |

(Continued)

FOREIGN PATENT DOCUMENTS

| | | |
|---|---|---|
| DE | 20 2015 006 991 U1 | 11/2015 |
| GB | 2 018 960 A | 10/1979 |

OTHER PUBLICATIONS

Italian Search Report for corresponding Italian Patent Application No. 102016000117919 dated May 15, 2017, 7 pages.

*Primary Examiner* — Bret Hayes
(74) *Attorney, Agent, or Firm* — Merchant & Gould P.C.

(57) ABSTRACT

An extension device (1) of a firearm (500) mounts in an operating configuration, to a muzzle (555) of a barrel (550) of the firearm (500). The extension device (1) includes a main body (10) which has an inner element (11) housable inside the barrel (550) and suitable to firmly engage with an inner barrel wall (550') and an outer element (12) which extends axially adjacent to the inner element (11) and is suitable to be arranged outside the barrel (550) with the inner element (11) housed in the barrel (550). The extension device further includes a secondary body (20) fitted axially on the main body (10) and an attachment body (30) fitted axially on the outer element (12) and fixable thereto performing an axial thrust action on the secondary body (20) until the secondary body presses against the muzzle (555) of the firearm (500).

13 Claims, 7 Drawing Sheets

(56) References Cited

U.S. PATENT DOCUMENTS

| | | | | |
|---|---|---|---|---|
| 5,394,633 | A | 3/1995 | Alessandri, Jr. | |
| 6,079,311 | A * | 6/2000 | O'Quinn | F41A 21/30 42/79 |
| 6,789,343 | B1 * | 9/2004 | Dietrich | F41A 21/40 42/79 |
| 2010/0050493 | A1 * | 3/2010 | Joseph | F41A 21/325 42/79 |

* cited by examiner

EXTENSION DEVICE OF A FIREARM

This application claims benefit of Serial. No. 102016000117919, filed 22 Nov. 2016 in Italy and which application is incorporated herein by reference. To the extent appropriate, a claim of priority is made to the above disclosed application.

BACKGROUND OF THE INVENTION

The present invention relates to an extension device of a firearm.

In other words, the present invention relates to an extension device mountable to a firearm to extend the length of the barrel thereof.

Preferably, the extension device object of the present invention finds particular application on rifles.

A multitude of extension devices of the barrel of a firearm are known in the prior art. Such device serves for lengthening the barrel of the firearm and thus lengthen the range of the shot.

In some embodiments, moreover, the extension devices are also suitable for varying the diameter of the muzzle (in that case they are also known as "bottlenecks") in order to achieve a concentration of the size of the shot pattern produced by the cartridge exploded by the firearm.

Typically, these devices are designed for sports, meaning both hunting and target practice, for example in a polygon.

In fact, it is not uncommon for a shooter to wish to have a longer line of sight, as it is not uncommon that the shooter desires a more concentrated shot pattern. Typically, these needs are obviated by a special extension device mountable to the firearm, preventing the shooter from having to change his firearm to meet these needs.

A drawback of known extension devices is that, once installed on the muzzle of the firearm, they do not have continuity between the barrel and the extension device, having instead a slit between the two parts. Besides, intuitively, the aesthetic impact, such a slit is a trouble for the shooter in the shooting operations and does not allow for continuity on the line of sight.

An example of an embodiment of these extension devices exhibiting such a drawback is shown in document U.S. Pat. No. 5,394,633.

SUMMARY OF THE INVENTION

The object of the present invention is to implement an extension device for a firearm which while fully meeting the product requirements, is adapted to overcome the above drawback of the prior art solutions.

BRIEF DESCRIPTION OF THE DRAWINGS

The features and the advantages of the extension device will appear more clearly from the following description, made by way of an indicative and non-limiting example according to the accompanying figures, in which:

FIG. 2' shows a longitudinal sectional view of the extension device and of the firearm barrel;

Figure 1:
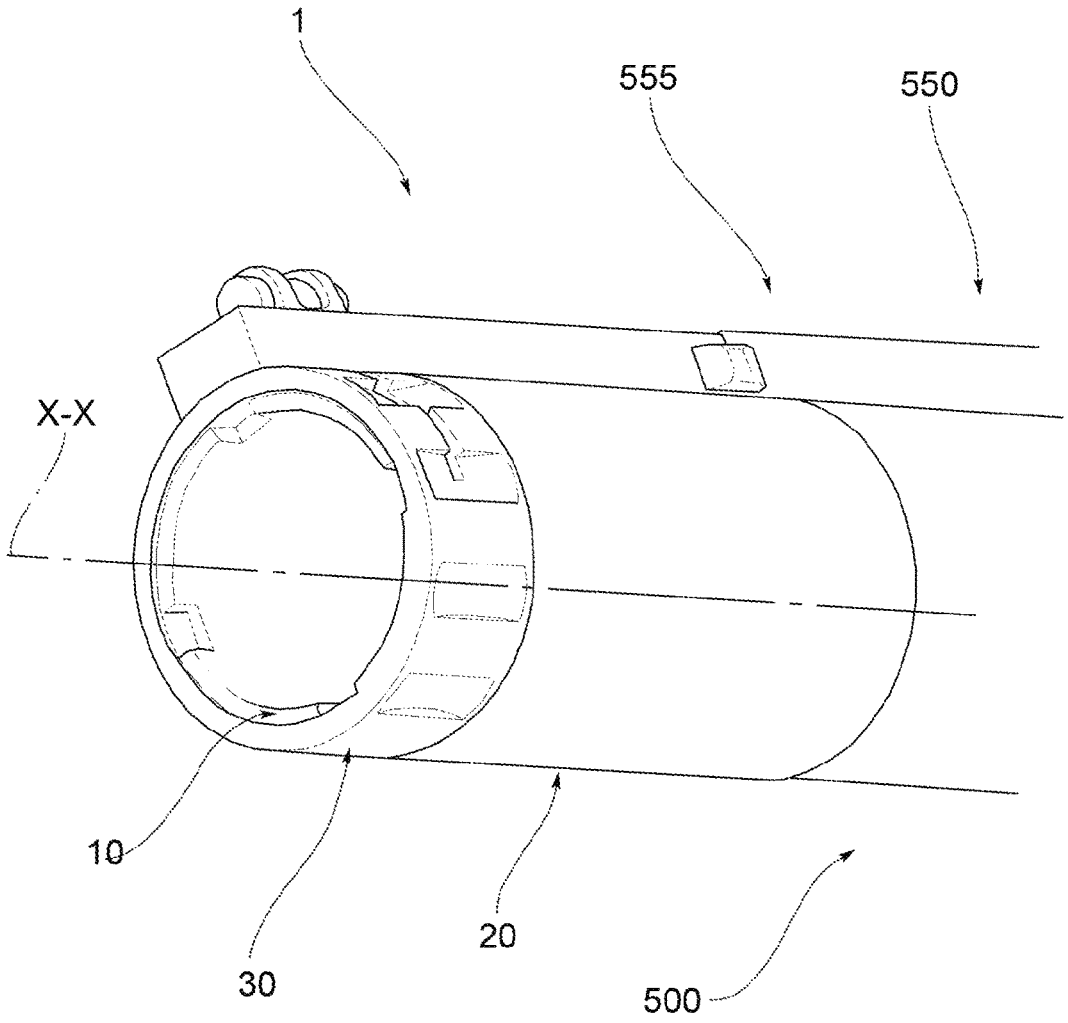
FIG. 1 represents a perspective view of an extension device according to the present invention, in an operating configuration, i.e. mounted to a muzzle of a firearm barrel.
Figure 2:
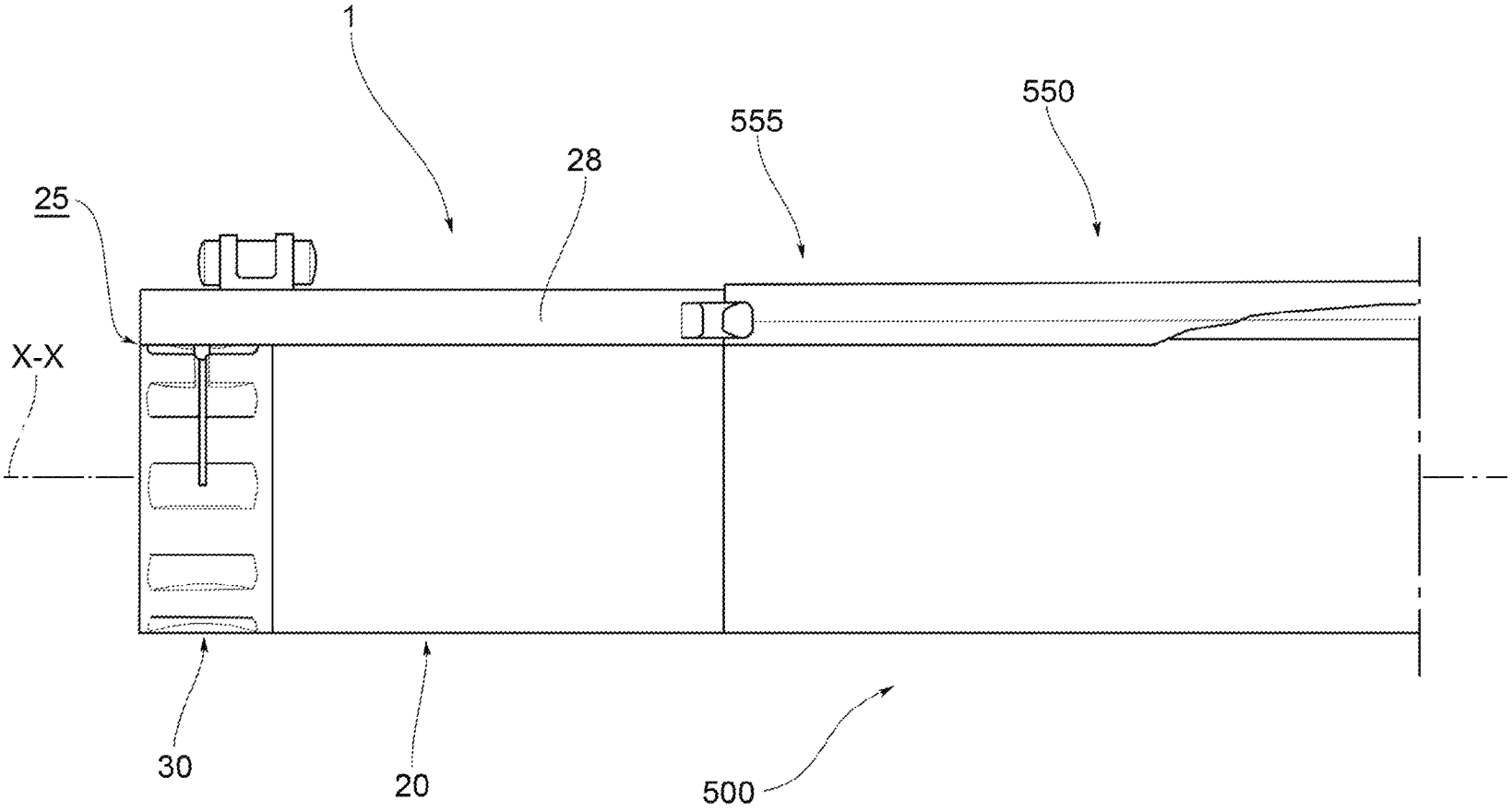
FIG. 2 illustrates a side view of FIG. 1, i.e. a side view of the extension device according to the present invention, in an operating configuration.
Figure 2:
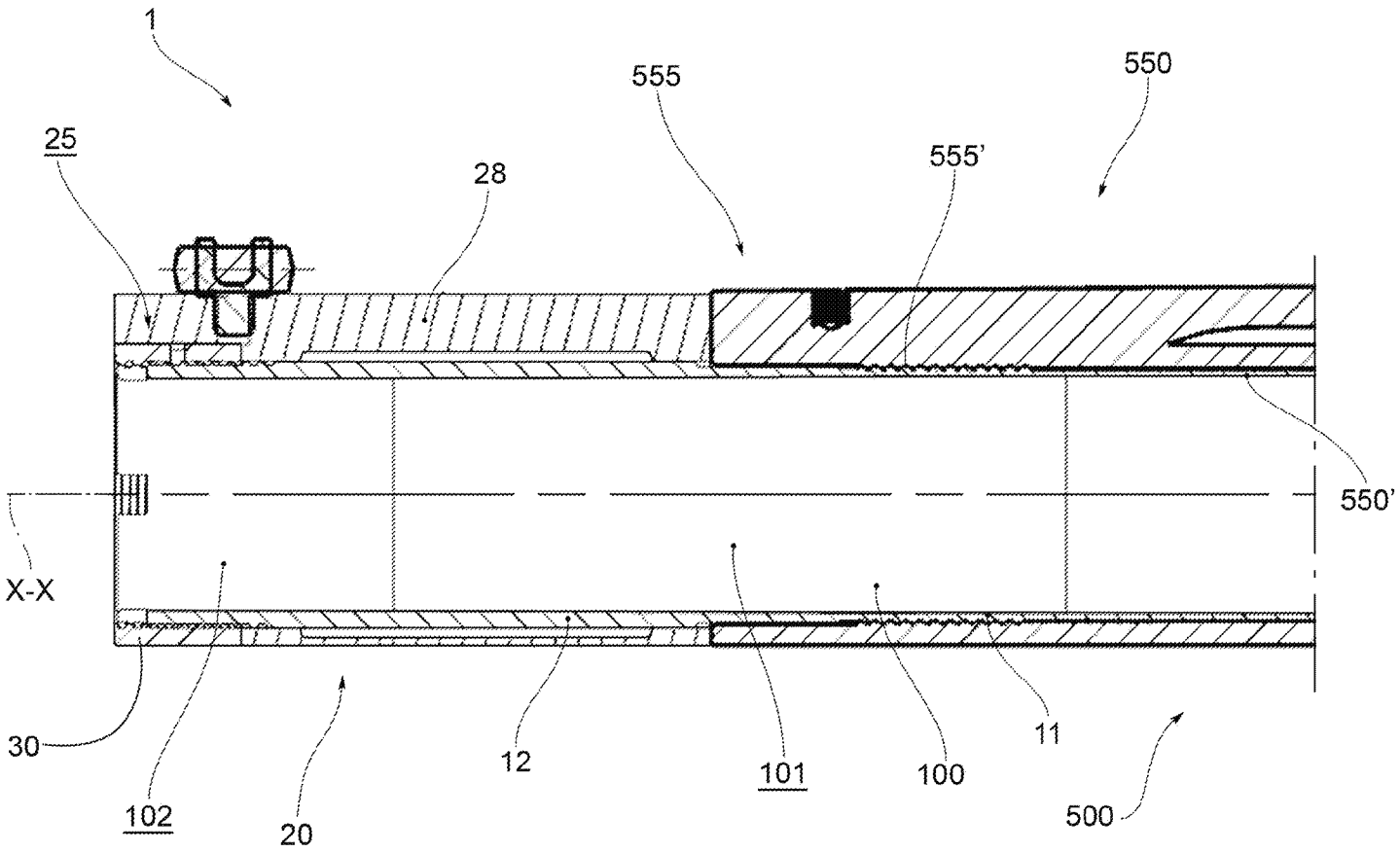
Figure 3A:
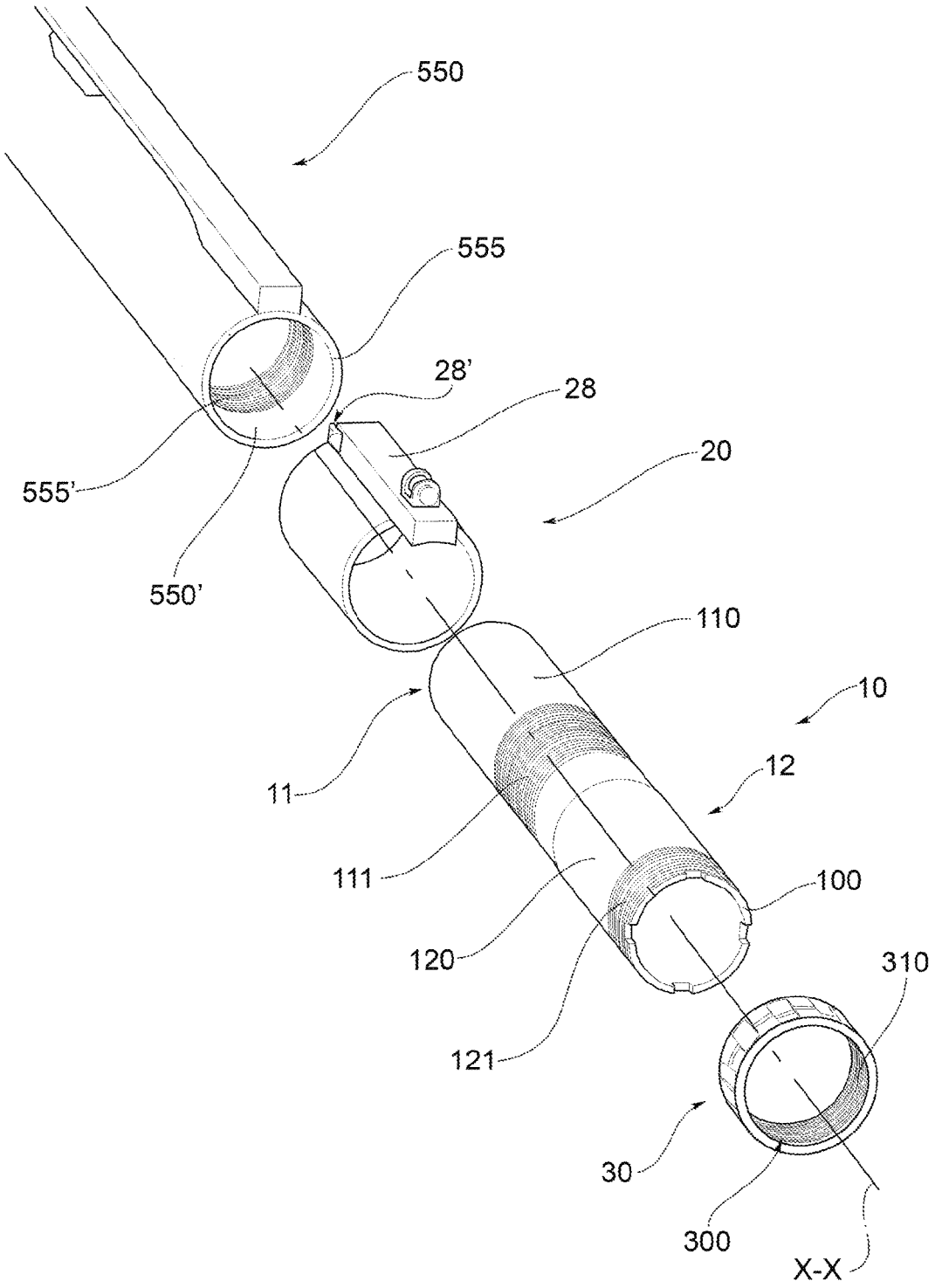
FIG. 3*a* represents a perspective view with separate parts of the extension device and of the firearm of the preceding figures.
Figure 3B:
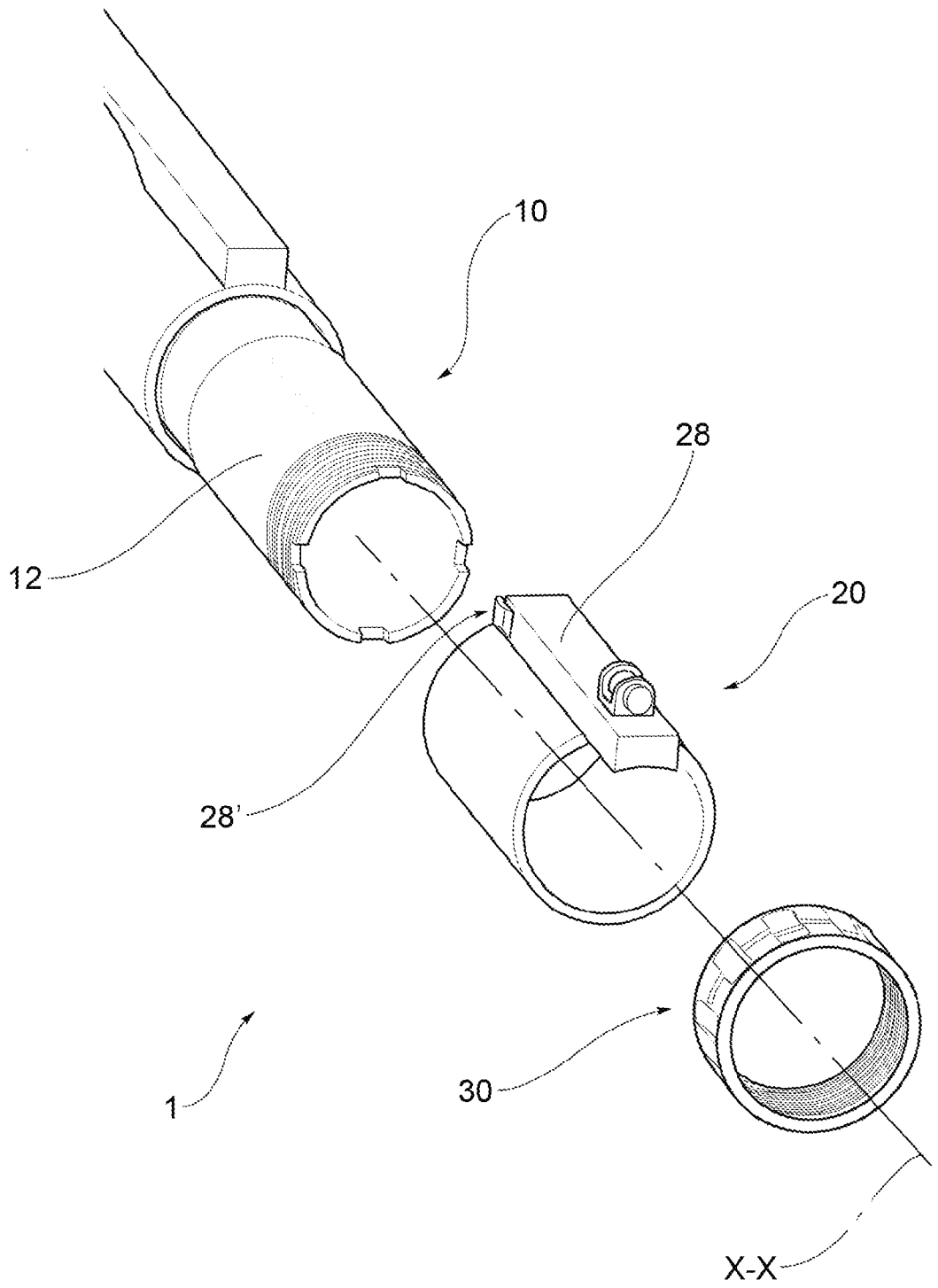
Figure 3C:
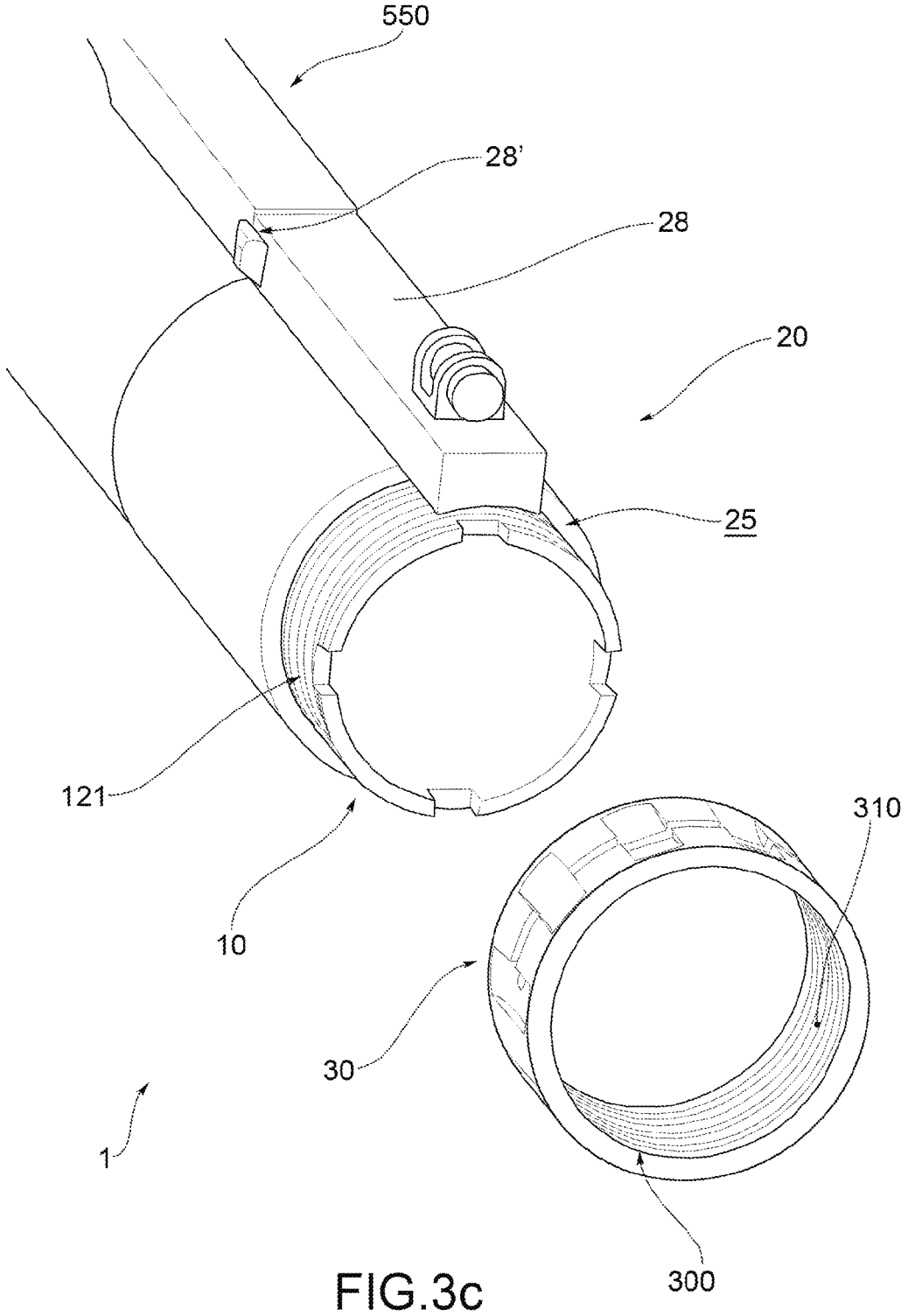
Figure 3D:
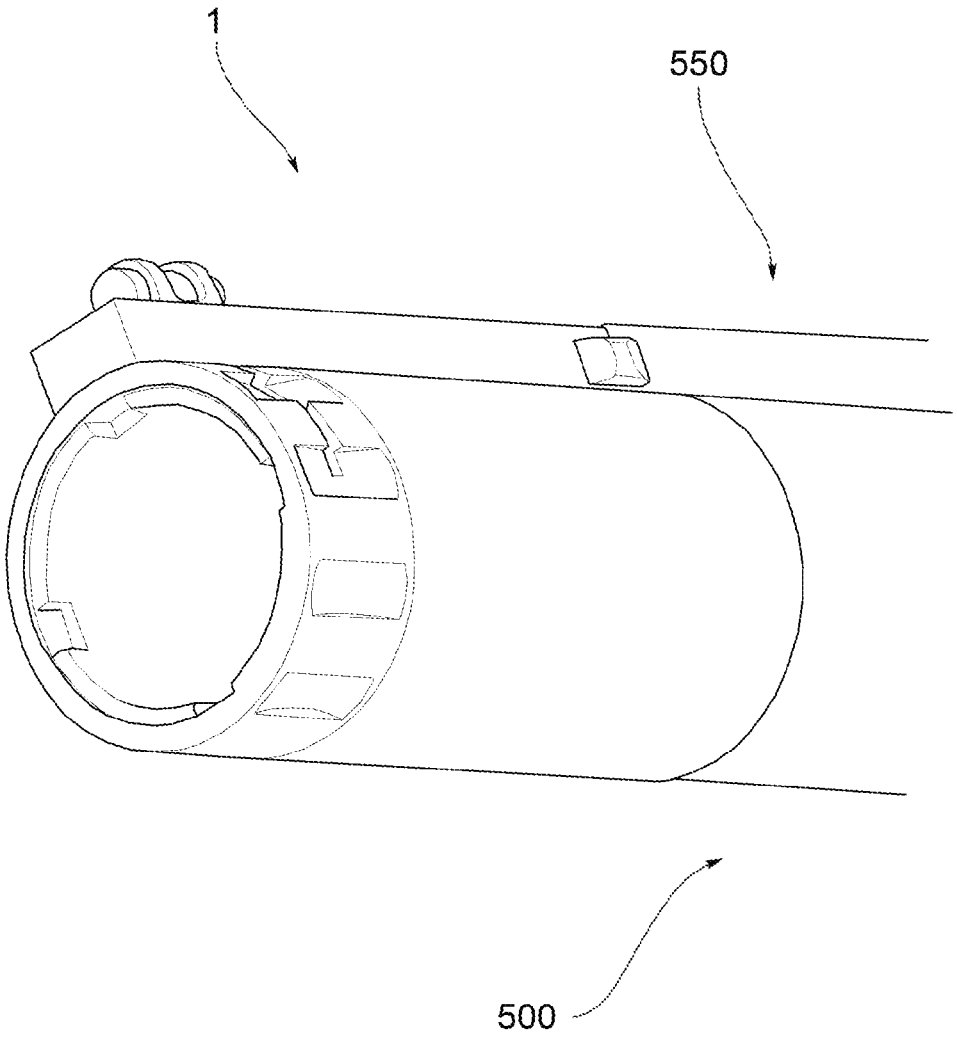

FIGS. from 3*b* to 3*d* show the respective mounting steps of the extension device according to a preferred embodiment, to a firearm, i.e. up to the operating configuration.

DETAILED DESCRIPTION OF THE PREFERRED EMBODIMENT

With reference to the accompanying figures, reference numeral 1 indicates an extension device according to the present invention.

The extension device is mountable to a firearm 500, in particular to the muzzle 555 of a barrel 550 of said firearm 500.

According to a preferred embodiment, said firearm 500 is a rifle. Preferably, the firearm is a rifle for sports use, i.e. is a rifle suitable for hunting, or a rifle for shooting at a target.

Preferably, the rifle is of the type with smooth barrel 550. In other words, barrel 550 has a smooth inner barrel wall 550'.

In addition, firearm 500 has a firearm thread 555' formed therein, on the barrel wall 550' in proximity to muzzle 555. As widely described hereinafter, the extension device 1 is adapted to be screwed to said firearm thread 555'.

According to the present invention, an operating configuration of the extension device 1 is defined as the configuration in which it is mounted to muzzle 555 of firearm 500 and this is ready for shooting.

In detail, the extension device 1 object of the present invention includes a main body 10 extending along an axis X-X. Preferably, said axis X-X, when the main body is mounted to firearm 500, corresponds with the extension axis of barrel 550.

The main body 10 comprises an inner element 11 housable inside the barrel 550 and, as described hereinafter, suitable to firmly engage with the inner barrel wall 550'.

According to a preferred embodiment, said inner element 11 is adapted to perfectly adhere with the inner barrel wall 550' so that there cannot be a flow of air between the two. In other words, the inner element 11 is designed with dimensions, sizes and tolerances such as to prevent the gases exploded by the firearm from being ejected other than through the firing cavity 101 described hereinafter.

Moreover, the main body 10 comprises an outer element 12 which extends axially adjacent to the inner element 11 and is suitable to be arranged outside the barrel 550 with the inner element 11 housed in barrel 550.

In other words, when the main body 10 is mounted to a barrel 550, it has a part housed therein, i.e. the inner element 11, and a part that extends outward from it, i.e. the outer element 12.

According to a preferred embodiment, the inner element 11 and the outer element 12 have the same radial dimensions with respect to axis X-X. In other words, the two components extend mutually adjacent without steps.

According to other preferred embodiments, the inner element 11 and the outer element 12 have different radial dimensions with respect to axis X-X. In other words, the inner element 11 is adapted to be housed in barrel 550 to firmly engage the inner barrel wall 550', while the outer element 12 is radially larger and has no space to be housed in the barrel. This means that the two components extend mutually adjacent with a step between them. In a preferred embodiment, the outer element 12 is adapted to abut on the edges of muzzle 555.

Additionally, the main body 10 comprises an inner wall 100 which defines around axis X-X a firing cavity 101. Preferably, through said firing cavity 101, the pellets contained by a fired cartridge pass.

According to a preferred embodiment, the inner wall 100 has a variable diameter with respect to axis X-X having a bottleneck portion 102 of diameter less than the diameter of the inner wall of the barrel 550'. According to this embodiment, the extension device 10 is therefore also adapted to act as a "bottleneck" and so it is adapted to concentrate the shot pattern.

Preferably, the bottleneck portion 102 has a diameter smaller than the diameter of the inner barrel wall 550'.

Specifically, in the embodiment in which the extension device is mountable to a 10 gauge rifle or a 12 gauge rifle or 16 gauge rifle, the bottleneck portion 102 has a diameter less than the diameter of the inner wall of the barrel 550' of 0.127 millimeters (0.005 inches) or of 0.254 millimeters (0.010 inches) or of 0.381 millimeters (0.015 inches) or of 0.508 millimeters (0.020 inches), or of 0.635 millimeters (0.025 inches) or of 0.762 millimeters (0.030 inches) or of 0.889 millimeters (0.035 inches) or of 1.016 millimeters (0.040 inches).

Moreover, in the embodiment in which the extension device is mountable to a 20 gauge rifle or 28 gauge rifle, the bottleneck portion 102 has a diameter less than the diameter of the inner wall of the barrel 550' of 0.076 millimeters (0.003 inches), 0.127 millimeters (0.005 inches) or of 0.2286 millimeters (0.009 inches) or of 0.304 millimeters (0.012 inches) or of 0.381 millimeters (0.015 inches) or of 0.457 millimeters (0.018 inches) or of 0.533 millimeters (0.021 inches) or of 0.609 millimeters (0.024 inches) or of 0.685 millimeters (0.027 inches).

Moreover, in the embodiment in which the extension device is mountable to a 410 gauge rifle, the bottleneck portion 102 has a diameter less than the diameter of the inner wall of the barrel 550' of 0.008 millimeters (0.003 inches), 0.127 millimeters (0.005 inches) or 0.178 millimeters (0.007 inches) or of 0.203 millimeters (0.008 inches) or of 0.254 millimeters (0.010 inches) or of 0.305 millimeters (0.012 inches) or of 0.355 millimeters (0.014 inches) or of 0.406 millimeters (0.016 inches) or of 0.457 millimeters (0.018 inches) or of 0.508 millimeters (0.020 inches).

According to a preferred embodiment, the bottleneck portion 102 is positioned in correspondence of the outer element 12 of the main body 10. In other words, only the outer element 12 of the main body acts as a bottleneck and not the inner element 11. Namely, the extension device 1 is adapted to not change the shooting ballistic by the entire length of barrel 550, but only outside it, in the stretch of the firing cavity 101 extending into the outer element 102 is the bottleneck, and thus the centralization action of the shot pattern.

According to a preferred embodiment, the inner element 11 has an outer assembly wall 110, radially spaced from the inner wall 100, wherein said outer assembly wall comprises a male assembly thread 111 screwable inside barrel 550 to the firearm thread 555' made inside it in proximity to muzzle 555.

According to the present invention, the extension device 1 comprises a secondary body 20 axially fitted on main body 10.

In other words, the outer element 12 of the main body 10 has an outer assembly wall 120, radially spaced from the inner wall 100, on which said secondary body 20 is fitted. The secondary body 20 is therefore adapted to fit on the outer element 12 until it abuts with firearm 500, i.e. in abutment with muzzle 555.

Preferably, the secondary body 20 is adapted to also extend the outer shape of barrel 550, replicating it perfectly.

In addition, again according to the present invention, the extension device 1 also comprises an attachment body 30, in turn fittable axially on the outer element 12 and fixable to the outer element 12 performing an axial thrust action on the secondary body 20 until it closes in a pack on muzzle 555 of firearm 500.

In other words, in a preferred embodiment, the attachment body 30 is also fittable on the outer assembly wall 120, so that this closes, in sandwich with the muzzle of the firearm, the secondary body 20.

According to a preferred embodiment, the outer assembly wall 120 comprises a male attachment thread 121.

According to a preferred embodiment, the attachment body 30 comprises a female attachment thread 310 adapted to interact with said male attachment thread 121. That is to say, the attachment body 30 is screwable on the outer element 12 of the main body 10.

According to a preferred embodiment, said male attachment thread 121 is formed in a distal end portion of the main body 10, i.e. is formed in a position as far as possible from muzzle 555, when the main body 10 is housed in barrel 550.

In addition, according to a preferred embodiment, the same secondary body 20 defines a head portion 25 in which the attachment body 30 is housed.

Moreover, according to a preferred embodiment, the secondary body 20 comprises a sight portion 28 adapted to lengthen the sight of firearm 500. Preferably, the sight portion 28 also allows repositioning the respective sight of the distal end of the firearm, at the end of the extension device 1 (shown by way of example in the attached drawings).

In a preferred embodiment, moreover, the sight portion 28 comprises centring teeth 28' suitable for adjusting the radial positioning with respect to axis X-X of the secondary body 20 on the main body 10. Preferably, the sight portion 28 aligned with barrel rib, 28, aligned with the barrel rib, completes the line of sight of firearm 500, extending it.

According to a preferred embodiment, the main body 10 has a substantially cylindrical shape with respect to axis X-X, the secondary body 20 in turn has a tubular shape to be fitted on the main body 10 and the attachment body 30 has a ring shape.

According to the foregoing, embodiments of the extension device can be contemplated which are a function of the firearm to which they are applied, both for the dimensions of the main body 10 (which must allow its mounting to the barrel) and for the shape of the secondary body 20 (which replicates the outer shape of the barrel). In other words, preferably, the extension device 1 is adapted to extend the barrel with interruption.

As fully shown in the accompanying figures, the assembly of the extension device involves the following steps:

- fitting the main body 10 inside barrel 550 of the firearm, fitting, preferably by screwing, the inner element 11;
- fitting the secondary body 20 on the main body 10, preferably on the outer element 12, preferably by placing the sight portion 28 in line with the barrel rib;
- fitting the attachment body 30, preferably by screwing it to the outer element 12, up to firmly attaching the secondary body 12 in a sandwich with the muzzle of barrel 550.

Innovatively, the extension device object of the present invention is adapted to fully solve the intended object, being adapted to increase the line-of-sight of a firearm provided therewith, without slits or spaces between it and the firearm.

Advantageously, none of the typical features of the extension devices are lacking in the extension device object of the present invention, but they are in fact contemplated and improved in their functionality.

In addition, advantageously, the extension device has a simple and intuitive assembly. Advantageously, all the clearances between the components (e.g. due to possible tolerance differences in their production) are eliminated by while continuing to fully achieve the intended object. In other words, advantageously, the extension device is designed to always close in a pack the secondary body on the muzzle of the firearm, through the action carried out in the assembly thereof by the attachment body.

In addition, advantageously, the assembly of the extension device is simple, intuitive and immediate, allowing the shooter a quick replacement of the extension device according to his needs. Advantageously, during a competition or a hunt, different types of bottleneck devices are mounted to the firearm through quick disassembly and assembly operations.

Advantageously, moreover, the bottleneck does not affect the ballistics of the firearm within it, but has the bottleneck portion located in the outer element of the main body, thus outside the barrel. Advantageously, therefore, the extension device object of the present invention, by including the nottleneck portion housed in the outer element, is adapted to fully simulate a longer barrel.

A man skilled in the art may make several changes or replacements of elements with other functionally equivalent ones to the embodiments of the above extension device in order to meet specific needs. For example, in a preferred embodiment, the engagement method of the attachment body on the main body contemplate different solutions but functionally similar to the screwing by threading, such as by providing a snap or bayonet coupling.

Also such variants are included within the scope of protection as defined by the following claims. Moreover, each variant described as belonging to a possible embodiment may be implemented independently of the other variants.

The invention claimed is:

1. Extension device of a firearm mountable in an operating configuration, to a muzzle of a barrel of the firearm, comprising:

i) a main body which extends along an axis and comprises an inner wall which defines around the axis a firing cavity, and comprises:
   an inner element housable inside the barrel and suitable to engage with an inner barrel wall;
   an outer element which extends axially adjacent to the inner element and is suitable to be arranged outside the barrel with the inner element housed in the barrel;

ii) a secondary body fitted axially on the main body;

iii) an attachment body fitted axially on the outer element and fixable to the outer element performing an axial thrust action on the secondary body until the attachment body presses the secondary body against the muzzle of the firearm.

2. Extension device according to claim 1, wherein the inner element has an outer assembly wall, radially spaced from the inner wall, wherein said outer assembly wall comprises a male assembly thread screwable inside the barrel to a firearm thread made inside the barrel in proximity to the muzzle.

3. Extension device according to claim 2, wherein the outer element has an outer attachment wall, radially spaced from the inner wall, comprising a male attachment thread and the attachment body comprises a female attachment thread suitable to interact with said male attachment thread.

4. Extension device according to claim 1, wherein the secondary body defines a head portion in which the attachment body is housed.

5. Extension device according to claim 1, wherein the secondary body comprises a sight portion suitable to allow distal positioning of the sight portion of the firearm.

6. Extension device according to claim 5, wherein the main body has a substantially cylindrical shape with respect to the axis, the secondary body has a tubular shape to be fitted on the main body and the attachment body has a ring shape.

7. Extension device according to claim 6, wherein the sight portion comprises centering teeth suitable for adjusting radial positioning with respect to the axis of the secondary body on the main body.

8. Extension device according to claim 1, wherein the inner wall has a variable diameter with respect to the axis having a bottleneck portion of a diameter less than a diameter of the inner wall of the barrel.

9. Extension device according to claim 8, wherein the bottleneck portion is positioned in correspondence of the outer element of the main body.

10. Extension device of a firearm according to claim 1, wherein said firearm is a rifle.

11. Extension device according to claim 10, wherein the extension device is mountable to a 10 gauge, 12 gauge or 16 gauge rifle and the bottleneck portion has a diameter less than a diameter of the inner wall of the barrel of 0.127 millimeters (0.005 inches) or of 0.254 millimeters (0.010 inches) or of 0.381 millimeters (0.015 inches) or of 0.508 millimeters (0.020 inches), or of 0.635 millimeters (0.025 inches) or of 0.762 millimeters (0.030 inches) or of 0.889 millimeters (0.035 inches) or of 1.016 millimeters (0.040 inches).

12. Extension device according to claim 10, wherein the extension device is mountable to a 20 gauge or 28 gauge rifle and the bottleneck portion has a diameter less than a diameter of the inner wall of the barrel of 0.076 millimeters (0.003 inches), 0.127 millimeters (0.005 inches) or of 0.2286 millimeters (0.009 inches) or of 0.304 millimeters (0.012 inches) or of 0.381 millimeters (0.015 inches) or of 0.457 millimeters (0.018 inches) or of 0.533 millimeters (0.021 inches) or of 0.609 millimeters (0.024 inches) or of 0.685 millimeters (0.027 inches).

13. Extension device according to claim 10, wherein the extension device is mountable to a 410 gauge rifle and the bottleneck portion has a diameter less than a diameter of the inner wall of the barrel of 0.008 millimeters (0.003 inches), 0.127 millimeters (0,005 inches) or 0.178 millimeters (0.007 inches) or of 0.203 millimeters (0.008 inches) or of 0.254 millimeters (0.010 inches) or of 0.305 millimeters (0.012 inches) or of 0.355 millimeters (0.014 inches) or of 0.406 millimeters (0.016 inches) or of 0.457 millimeters (0.018 inches) or of 0.508 millimeters (0.020 inches).

* * * * *